US009394613B2

(12) United States Patent
Jaworowski et al.

(10) Patent No.: US 9,394,613 B2
(45) Date of Patent: Jul. 19, 2016

(54) PROCESSES FOR APPLYING A CONVERSION COATING WITH CONDUCTIVE ADDITIVE(S) AND THE RESULTANT COATED ARTICLES

(75) Inventors: Mark R. Jaworowski, Glastonbury, CT (US); Sarah Arsenault, Vernon, CT (US); James T. Beals, West Hartford, CT (US)

(73) Assignee: United Technologies Corporation, Farmington, CT (US)

( * ) Notice: Subject to any disclaimer, the term of this patent is extended or adjusted under 35 U.S.C. 154(b) by 0 days.

(21) Appl. No.: 13/198,362

(22) Filed: Aug. 4, 2011

(65) Prior Publication Data

US 2011/0287188 A1 Nov. 24, 2011

Related U.S. Application Data

(62) Division of application No. 12/202,949, filed on Sep. 2, 2008.

(60) Provisional application No. 60/999,740, filed on Aug. 31, 2007.

(51) Int. Cl.
*B05D 3/02* (2006.01)
*C23C 26/00* (2006.01)
(Continued)

(52) U.S. Cl.
CPC ..... *C23C 26/00* (2013.01); *C23C 18/10* (2013.01); *C23C 18/127* (2013.01); *C23C 18/1216* (2013.01); *C23C 18/1225* (2013.01);
(Continued)

(58) Field of Classification Search
USPC ..... 427/402, 376.2
See application file for complete search history.

(56) References Cited

U.S. PATENT DOCUMENTS 3,330,697 A 7/1967 Pechini
3,551,266 A * 12/1970 Seitzinger et al. ..... 428/119
(Continued)

FOREIGN PATENT DOCUMENTS

EP 0837112 A2 4/1998
WO 02/072682 A1 9/2002
(Continued)

OTHER PUBLICATIONS

Webpage capture from Mar. 17, 2006 concerning the term Conversion coating: http://web.archive.org/web/20060317051936/http://engineershandbook.com/MfgMethods/conversioncoating.htm.*
(Continued)

*Primary Examiner* — Nathan Empie
(74) *Attorney, Agent, or Firm* — Bachman & LaPointe, PC

(57) ABSTRACT

A process for coating an article includes the steps of contacting an article with a first solution to produce a coated article, the first solution includes a solvent and at least one non-conductive material comprising at least one oxide of a metal; contacting with a second solution the coated article having at least one surface with a non-conductive material layer, the second solution includes a solvent and at least one conductive material comprising at least one of the foregoing: graphite, metals, conductive ceramics, semi-conductive ceramics, intermetallic compounds, and mixtures thereof; and drying the coated article having at least one surface with a non-conductive material layer having the at least one conductive material in contact with at least one surface of the non-conductive material layer and the at least one surface of the article.

10 Claims, 3 Drawing Sheets

(51) Int. Cl.

| | |
|---|---|
| ***C23C 18/10*** | (2006.01) |
| ***C23C 18/12*** | (2006.01) |
| ***C23C 22/76*** | (2006.01) |
| ***C25D 5/48*** | (2006.01) |

(52) U.S. Cl.

CPC ..... *C23C18/1241* (2013.01); *C23C 18/1295* (2013.01); *C23C 22/76* (2013.01); *C25D 5/48* (2013.01); *Y10T 428/24942* (2015.01); *Y10T 428/249956* (2015.04); *Y10T 428/31678* (2015.04)

(56) References Cited

U.S. PATENT DOCUMENTS

| | | | | | |
|---|---|---|---|---|---|
| 3,873,469 | A | * | 3/1975 | Foster et al. | 502/242 |
| 4,737,799 | A | * | 4/1988 | Kato | B41J 2/3357 338/308 |
| 4,812,363 | A | | 3/1989 | Bell et al. | |
| 5,085,696 | A | * | 2/1992 | Muller et al. | 106/14.16 |
| 5,219,787 | A | * | 6/1993 | Carey et al. | 438/637 |
| 5,354,441 | A | | 10/1994 | Matsuo et al. | |
| 5,399,432 | A | | 3/1995 | Schleifstein et al. | |
| 5,614,294 | A | | 3/1997 | Downs et al. | |
| 5,639,565 | A | | 6/1997 | Boyd et al. | |
| 5,643,499 | A | | 7/1997 | Boyd et al. | |
| 5,871,839 | A | | 2/1999 | Boyd et al. | |
| 5,925,228 | A | * | 7/1999 | Panitz | C23C 4/18 204/484 |
| 6,150,032 | A | | 11/2000 | Yang et al. | |
| 6,153,022 | A | | 11/2000 | Yoshida et al. | |
| 6,222,166 | B1 | * | 4/2001 | Lin et al. | 219/538 |
| 6,451,443 | B1 | | 9/2002 | Daech | |
| 6,537,678 | B1 | | 3/2003 | Putnam et al. | |
| 6,558,480 | B1 | | 5/2003 | Rochfort et al. | |
| 6,613,390 | B2 | | 9/2003 | Jaworowski et al. | |
| 6,764,553 | B2 | | 7/2004 | Dolan | |
| 6,821,633 | B2 | | 11/2004 | Liu et al. | |
| 6,972,098 | B1 | | 12/2005 | Viswanathan | |
| 7,250,193 | B2 | | 7/2007 | Matsukawa et al. | |
| 2001/0038923 | A1 | * | 11/2001 | Schneider et al. | 428/632 |
| 2002/0145134 | A1 | * | 10/2002 | Olding et al. | 252/500 |
| 2002/0149651 | A1 | | 10/2002 | Moriya et al. | |
| 2004/0166435 | A1 | | 8/2004 | Lee et al. | |
| 2004/0175631 | A1 | | 9/2004 | Crocker et al. | |
| 2004/0253091 | A1 | * | 12/2004 | Iida et al. | 414/935 |
| 2006/0134339 | A1 | | 6/2006 | Wang et al. | |
| 2007/0023738 | A1 | * | 2/2007 | Olding et al. | 252/514 |

FOREIGN PATENT DOCUMENTS

| | | | |
|---|---|---|---|
| WO | 03/027203 | A2 | 4/2003 |
| WO | 2004/016698 | A1 | 2/2004 |

OTHER PUBLICATIONS

Bulent E. Yoldas, Alumina Sol Preparation from Alkoxides, American Ceramic Society Bulletin, 54(3):289-90 1975.

Vincent et al., "Inclusion of Carbon nanotubes in a TiO2 sol-gel matrix", Journal of Non-Crystalline Solids, vol. 311, 2002, pp. 130-137.

Gavalas et al., "Carbon nanotube Sol-Gel Composite Materials", Nano Letters, vol. 1, No. 12, 2001, pp. 719-721.

* cited by examiner

PROCESSES FOR APPLYING A CONVERSION COATING WITH CONDUCTIVE ADDITIVE(S) AND THE RESULTANT COATED ARTICLES

CROSS-REFERENCE

This application is the U.S. Divisional Application of Ser. No. 12/202,949 filed Sep. 2, 2008, which is a non-provisional application that claims priority to U.S. Provisional Application Ser. No. 60/999,740, entitled "Processes for Applying a Conversion Coating with Conductive Additive(s) and the Resultant Coated Articles", filed on Aug. 31, 2007.

FIELD OF THE INVENTION

The invention relates to conversion coatings and, more particularly, relates to process(es) for applying conversion coatings with conductive additives and the resultant coated articles.

BACKGROUND OF THE INVENTION

Aluminum alloy conversion coatings provide a combination of corrosion inhibition and apparent surface electrical conductivity. Current state-of-the art trivalent chromium conversion coatings do not demonstrate stable surface conductivity. Evidence exists that hexavalent chromate conversion coatings do not impart true electronic conductivity, but provide metal-to-metal contact due to localized failure of the passive film under load. The superb corrosion inhibition and passive film "self repair" provided by chromate conversion coatings permits them to be used in applications where surface conductivity is required. Due to their carcinogenic properties, however, hexavalent chromium coatings are heavily regulated and are thus to be avoided whenever possible.

SUMMARY OF THE INVENTION

In accordance with one aspect of the present disclosure, a process for coating an article broadly comprising contacting an article with a first solution to produce a coated article, the first solution includes a solvent and at least one non-conductive material comprising at least one oxide of a metal; contacting with a second solution the coated article having at least one surface with a non-conductive material layer, the second solution includes a solvent and at least one conductive material comprising at least one of the foregoing: graphite, metals, conductive ceramics, semi-conductive ceramics, intermetallic compounds, and mixtures thereof; and drying the coated article having at least one surface with a non-conductive material layer having the at least one conductive material in contact with at least one surface of the non-conductive material layer and the at least one surface of the article.

In accordance with another aspect of the present disclosure, a process for coating an article broadly comprises contacting an article with a solution to produce a coated article, the solution includes a solvent, at least one non-conductive material comprising at least one oxide of a metal, and at least one conductive material comprising at least one of the foregoing: graphite, metals, conductive ceramics, semi-conductive ceramics, intermetallic compounds, and mixtures thereof; and drying the coated article having at least one surface with a non-conductive material layer having the at least one conductive material in contact with at least one surface of the non-conductive material layer and the at least one surface of the article.

In accordance with yet another aspect of the present disclosure, a coated article broadly comprises at least one surface having a coating disposed thereupon, wherein the coating includes a non-conductive material layer having at least one conductive material in contact or proximate to a surface of the non-conductive material layer and the at least one surface.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
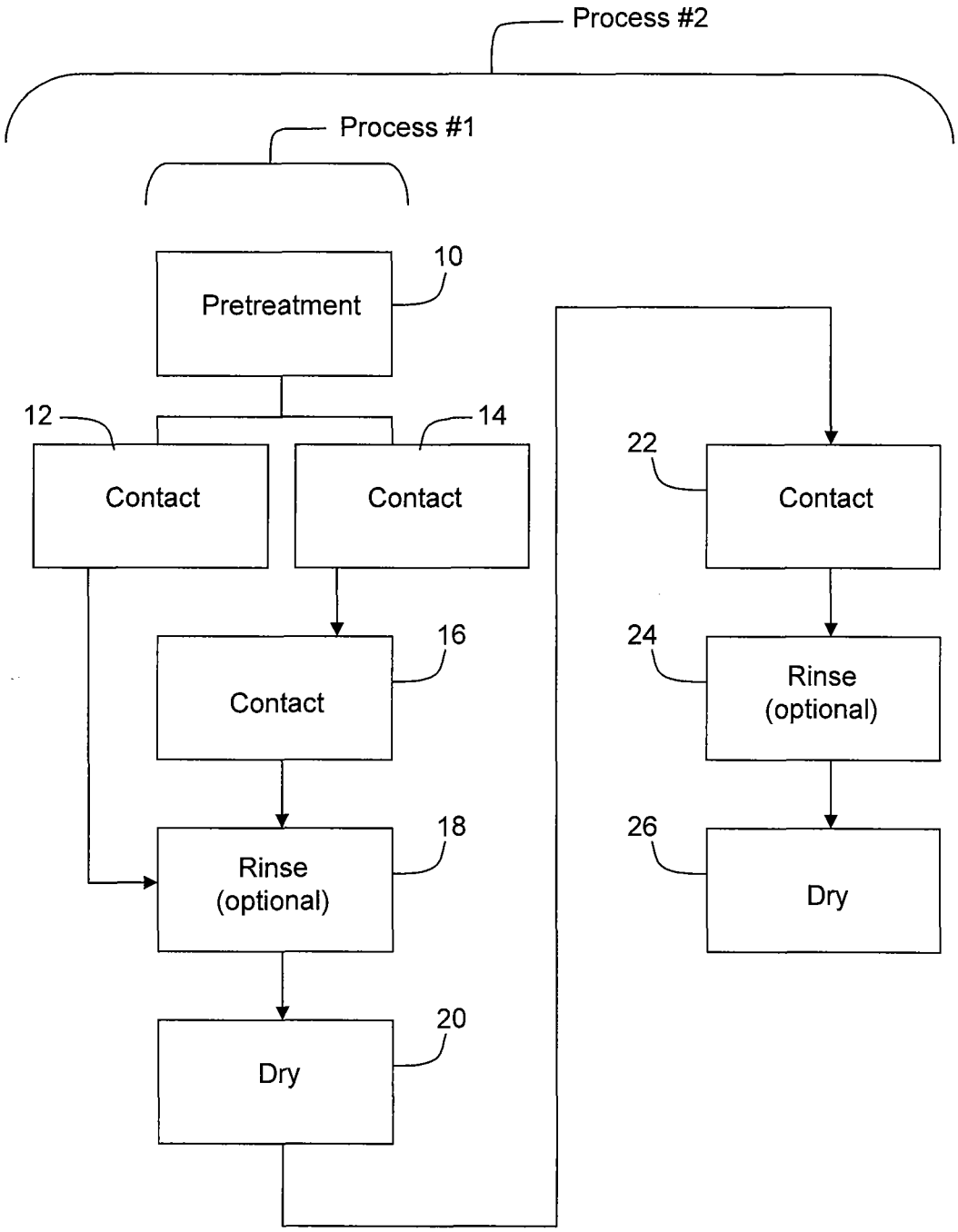
FIG. 1 is a flowchart illustrating the steps of an exemplary process described herein.

Generally, it is widely recognized that metal parts are not homogeneous throughout. Their base alloys such as zinc, titanium, steel, nickel, aluminum, and mixtures thereof, and contain intermetallic particles such as copper, manganese, iron, silicon, zinc, magnesium, chromium, titanium, and the like, depending upon the type of alloy, as known to one of ordinary skill in the art. Intermetallic particles exposed at the surface of the part serve as active corrosion site(s). The exemplary conversion coatings described herein contain a non-conductive phase and an electrically conductive phase. Generally, the non-conductive phase may by a typical metal oxide or metal oxide mixture, while the conductive phase may be bonded to the surface and, or in the alternative, to intermetallic particles on the surface of the article and prevent corrosion from occurring.

As used herein, the terms "non-conductive phase" and "non-conductive material" may include non-conductive materials selected from any one or more of the following: metal oxides; metal oxide mixture; metal oxides of an alloy(s) of an article; and the like.

As used herein, the terms "electrically conductive phase" and "electrically conductive materials" may include conductive particles selected from any one or more of the following: graphite fibers and nanotubes; metals, including wires, tubes, and electrodeposits; conductive or semi-conductive ceramics; and, intermetallic compounds in wire, rod or tube form, combinations comprising at least one of the foregoing, and the like. A portion of, if not all of, the electrically conductive materials may undergo surface modification via chemical pretreatment, thermal pretreatment, mechanical pretreatment and/or plasma pretreatment, prior to their use, to control the surface charge or the point of zero charge on the particle, which will enhance the segregation and agglomeration in the vicinity of the non-conductive material.

As used herein, the term "corrosion inhibiting species" may include organic corrosion inhibiting species such as, but not limited to, benzothiazolyl thio succinic acid, benzotriazole, toluoyl propionic acid, dimercaptothiodiazole, 2-mercaptobenzimidazole, and mixtures thereof; and, inorganic corrosion inhibiting species such as, but not limited to, tungstates, phosphates, molybdates, vanadates, permagnates, titananates and silicates of certain metals, such as sodium silicate, and zinc salts, including zinc molybdate, zinc phosphate and zinc oxide, also including cobalt compounds, compounds of cerium or other lanthanide metals; and further including alkaline earth and zinc salts of hexavalent chromium and mixtures thereof; and combinations comprising at least one of the foregoing species, and the like, as known to one of ordinary skill in the art.

Generally, overlay coatings are applied in a predetermined composition and do not interact significantly with the substrate during the deposition process as known to one of ordinary skill in the art. The overlay composite conversion coating described herein may be applied by various processes known to those of ordinary skill in the art, such as by immersion, air spray, electrostatic deposition, brush application, flood coating, chemical conversion, diffusion processes (e.g., inward, outward, etc.), low pressure plasma-spray, air plasma-spray, sputtering, cathodic arc, electron beam physical vapor deposition, high velocity plasma spray techniques (e.g., HVOF, HVAF), combustion processes, wire spray techniques, laser beam cladding, electron beam cladding, sol gel, cold spray, sputtering, chemical vapor deposition, combinations comprising at least one of the foregoing processes, and the like, as known to one of ordinary skill in the art.

Referring now to FIG. 1, a representative flowchart illustrating two exemplary processes described herein are shown. Generally, process #1 may be utilized to form an exemplary embodiment of a coated article (See FIGS. 2-3) as well as serve as precursor steps to performing process #2. Process #2 may be utilized to form another exemplary embodiment of another coated article (See FIGS. 4-5). In preparation of being coated, an article may optionally undergo pretreatment at step 10, such as an abrasive cleaning technique, e.g., deoxidizing, degreasing, and the like, followed by optional rinsing and drying steps as known to one of ordinary skill in the art. For example, one or more surfaces to be coated may be abrasively treated. Afterwards, the abrasively cleaned article may be washed in a mild detergent, and then rinsed with tap water, deionized water or ethanol as known to one of ordinary skill in the art. In addition, a chemical etch or deoxidizing surface treatment step followed by a water rinse may also optionally be applied after washing in a mild detergent as known to one of ordinary skill in the art.

After pretreating the article at step 10, the article may be contacted at step 12 with a solution comprising a solvent, a non-conductive material and a conductive material. Suitable solvents may include any solvents capable of dissolving the non-conductive material. Suitable contacting techniques may include immersion, spraying, brushing, combinations comprising at least one of the foregoing processes, and the like. Suitable nonconductive materials may include inorganic conversion coatings and sol-gel coatings as known to one of ordinary skill in the art. Suitable conductive materials may include may include metals such as nickel, copper, gold, silver, indium, tin, cobalt, palladium, zinc and bismuth; dispersed conductive particles containing aluminum, zinc, Zn/intermetallic compound, Sn/intermetallic compound, Al/intermetallic compound, $In_xO_y$, $Sn_xO_y$, the aforementioned metals, and combinations comprising at least one of the foregoing dispersed conductive particles; dispersed conductive intermetallic particles containing the aforementioned elements; and, dispersed oxide particles containing the aforementioned elements.

Alternatively, after pretreating the article at step 10, the article may be contacted at step 14 with a solution comprising a solvent and a non-conductive material. Suitable solvents may include any solvents capable of dissolving the non-conductive material. Suitable contacting techniques may include immersion, spraying, brushing, combinations comprising at least one of the foregoing processes, and the like.

Once the non-conductive layer is applied, the article may be contacted again at step 16 in a solution containing a solvent and an electrically conductive material. Suitable solvents may include any solvents capable of dissolving the electrically conductive material as known to one of ordinary skill in the art. During the contacting step 16, the electrically conductive material infiltrates the pores of the non-conductive material layer. Suitable electrically conductive materials may include metals such as nickel, copper, gold, silver, indium, tin, cobalt, palladium, zinc and bismuth; dispersed conductive particles containing aluminum, zinc, Zn/intermetallic compound, Sn/intermetallic compound, Al/intermetallic compound, $In_xO_y$, $Sn_xO_y$, the aforementioned metals, and combinations comprising at least one of the foregoing conductive particles; dispersed conductive intermetallic particles containing the aforementioned elements; and, dispersed oxide particles containing the aforementioned elements. In particular, suitable electrically conductive materials for pore-filling as described herein may include nickel, copper, gold, silver, indium, tin, palladium or cobalt introduced as electroless metallic deposits in the pores, and fine particles (less than 1 micron in diameter) containing aluminum, zinc, Zn/intermetallic compound, Sn/intermetallic compound, Al/intermetallic compound, $In_xO_y$, $Sn_xO_y$, and mixtures thereof. The solution may contain the electrically conductive material in an amount of about 10 parts per million to about 100,000 parts per million by weight of the solution.

During all contacting steps 12, 14 and 16, the pH may fluctuate throughout the process due to the sensitive nature of the chemistries involved as known to one of ordinary skill in the art. The solution may be monitored to maintain a pH range of about 3.5 to about 10.5. The article may be contacted with the solution for a period of time of about 1 minute to about 10 minutes to form the coating.

After contacting the article at step 12 or, in the alternative, after step 16, the coated article may be rinsed at step 18 using any one of a number of techniques known to one of ordinary skill in the art and dried at step 20. Suitable drying techniques include conventional techniques such as by air, heating element, infrared element, combinations comprising at least one of the foregoing, and the like, as known to one of ordinary skill in the art. For example, the coated article may be dried at a temperature of about 25° C. (77° F.) to about 125° C. (257° F.) for a period of time of about 0.5 hours to about 24 hours.

Figure 2:
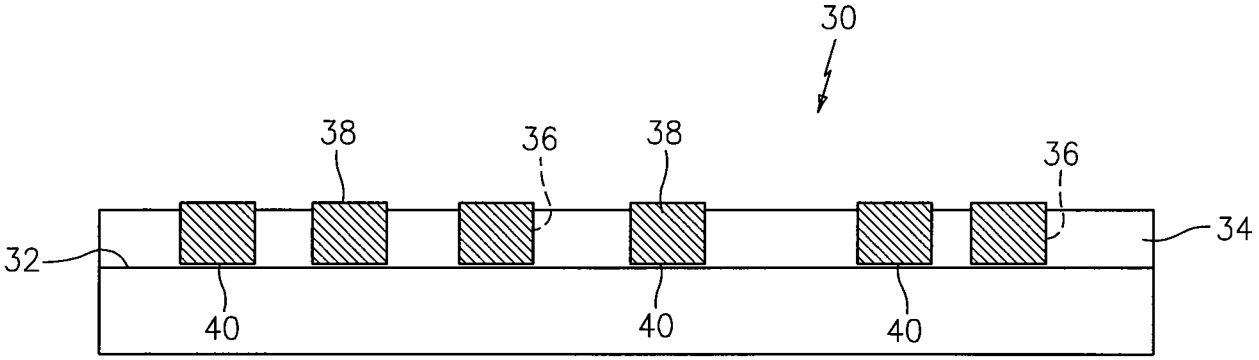
FIG. 2 is a representation of yet another exemplary coated article made in accordance with the exemplary processes #1 of FIG. 1.

Referring specifically to FIG. 2, a resultant coated article 30 of process #1 may comprise at least one surface 32 having disposed thereupon a non-conductive material layer 34 possessing a plurality of pores 36 filled with a quantity of conductive material 38. The conductive material upon making contact with an exposed surface 40 of the article 30 gradually builds up within the pores 36 until reaching, or at least proximately reaching, the surface 40 of the non-conductive material layer 34. The resulting non-conductive material layer 34 may have a thickness of about 50 nanometers to about 1000 nanometers.

Figure 3:
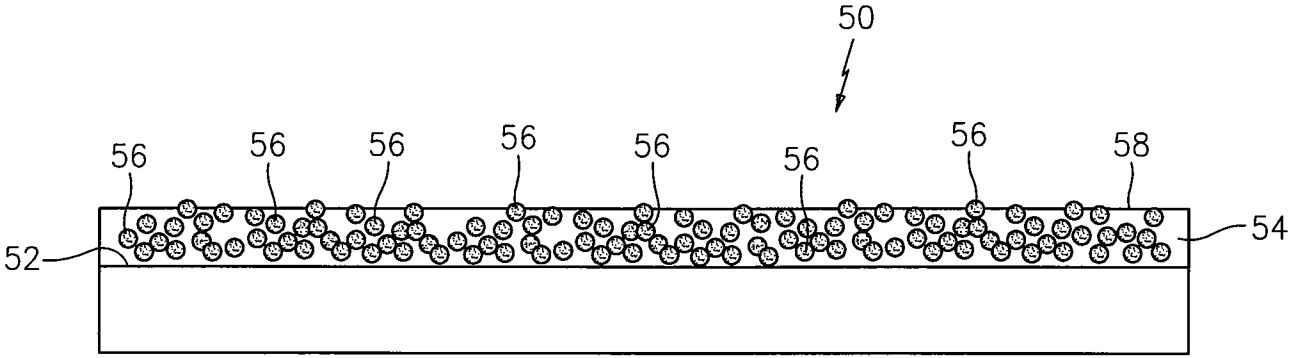
FIG. 3 is a representation of yet another exemplary coated article made in accordance with the exemplary process #1 of FIG. 1.

Referring specifically to FIG. 3, another resultant coated article 50 of process #1 may comprise at least one surface 52 having disposed thereupon a non-conductive material layer 54 having a plurality of electrically conductive material 56 dispersed throughout the layer 54. The electrically conductive material 56 forms a percolation network extending from the surface 52 of the article 50 to, or at least proximate to, a surface 58 of the non-conductive material layer 54. The resultant non-conductive material layer 54 may include the electrically conductive material 56 in an amount of about 40% to about 60% by volume of the total volume of the non-conductive material layer 54.

As described above, the coated article may undergo further steps to form yet additional exemplary embodiment of an exemplary process, exemplary coating and exemplary coated article described herein. The coated articles of FIGS. 2 and 3 may again be contacted at step 22 with a solution comprising a solvent and an electrically conductive material, to form an electrically conductive material layer upon the non-conductive material layer of the articles 30, 50.

Suitable coating processes may include immersion, air spray, electrostatic deposition, brush application, flood coating, chemical conversion, inward diffusion, outward diffusion, low pressure plasma-spray, air plasma-spray, sputtering, cathodic arc, electron beam physical vapor deposition, high velocity plasma spray techniques, combustion processes, wire spray techniques, laser beam cladding, electron beam cladding, sol gel, cold spray, sputtering, chemical vapor deposition, combinations comprising at least one of the foregoing, and the like, as known to one of ordinary skill in the art.

For example, a sol gel overlay coating solution may be prepared from a group IV metal based organic compound with the addition of a conductive material in the presence or absence of an alcohol, ketone, or similar solvents. For example, the group IV metal may be aluminum and the compound may be an aluminum isopropoxide compound. In this example, the gels are formed by processing metal alkoxides, first hydrolyzing and then polymerizing to form the gel as known to one of ordinary skill in the art. The group IV metal may comprise approximately 0 to approximately 90 weight % of the sol gel based upon the total atom % of the sol gel. During preparation, the pH of the sol gel is carefully controlled. Fracture of the conversion coating may be prevented through the addition of one or more chemical additives, such as surfactants, drying control chemical additives, and the like, and other processing techniques known to one of ordinary skill in the art. Once prepared, the sol gel may undergo an optional rinsing step (not shown) to thin the gel and displace any excess solvent present as known to one of ordinary skill in the art. The articles may undergo a heat treatment at a temperature of up to about 125° C. (257° F.) to fully evaporate the gel and form a uniform coating. Heat treatment temperatures may be reduced by careful replacement of water with alcohols and other volatile solvents as known to one of ordinary skill in the art. Additional nano-particulate inhibitors or conductive materials may also be added to the gel to form reservoirs of inhibitive species to promote self-healing as known to one of ordinary skill in the art.

In the alternative, the overlay coating solution may be formed through traditional polymerization techniques to form a polymer gel with the entrapped conductive material and group IV metal as known to one of ordinary skill in the art. In this alternative example, multi-component oxides may be achieved by dissolving hydrous oxides or alkoxides together with polyhydroxy alcohol and a chelating agent. The introduction of this organic polymer component to the inorganic sol gel will lead to more flexible and functionalized films. Additional nano-particulate inhibitors or conductive materials may also be added to the sol to form reservoirs of inhibitive species to promote self-healing.

In this alternative embodiment of contacting step 22, the overlay coating may be formed by exposing an article to the sol gel solution through immersion, spray or brush contact. Adhesion to the article may be achieved by the possible addition of binding agents known to one of ordinary skill in the art. Alloy pretreatment may be accomplished by conventional degreasing and deoxidizing steps. The resulting mixed metal oxide barrier film having an electrically conductive material may have a thickness of about 100 nanometers to about 1000 nanometers and be crack free and resistant to corrosion.

After contacting the article at step 22, the coated article may undergo an optional rinsing step at step 24 to remove excess solvents and other contaminants. The coated article may be dried at step 26 using conventional techniques such as by air, a heating element, or infrared element. For example, the coated article may be dried at a temperature of about 25° C. (77° F.) to about 125° C. (257° F.) for a period of time of about 0.5 hours to about 24 hours to fully evaporate the water and other volatile species and form a uniform coating.

Figure 4:
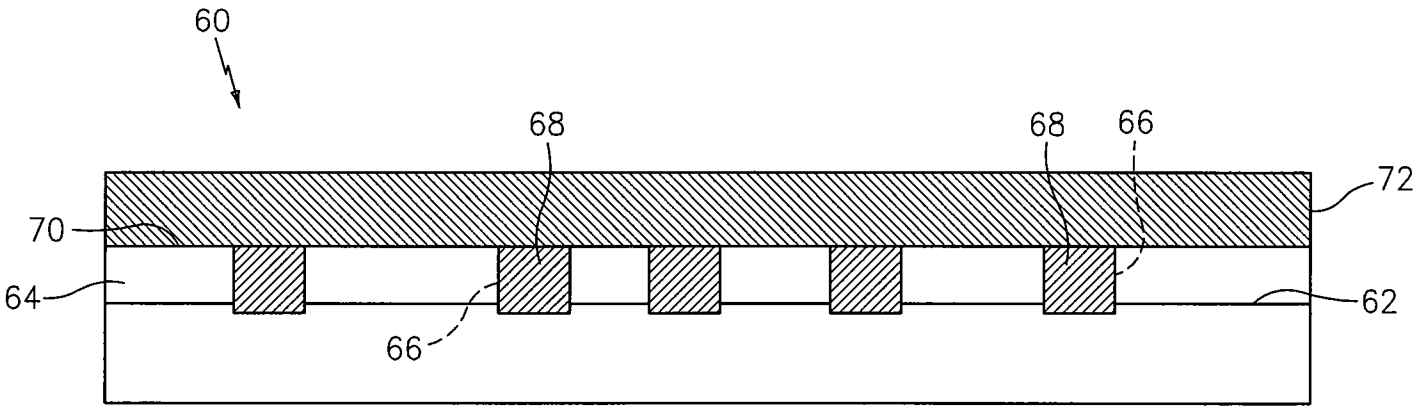
FIG. 4 is a representation of still yet another exemplary coated article made in accordance with the exemplary process #2 of FIG. 1.

Referring specifically to FIG. 4, a resultant coated article 60 of process #2 may comprise at least one surface 62 having disposed thereupon a non-conductive material layer 64 possessing a plurality of pores 66 filled with a quantity of conductive material 68 as described above with reference to article 30. The article 60 further includes a conductive material layer 72 disposed upon a surface 70 of the non-conductive material layer 64. The resulting total thickness of the combined layers 64, 72 may be about 50 nanometers to about 2000 nanometers.

Figure 5:
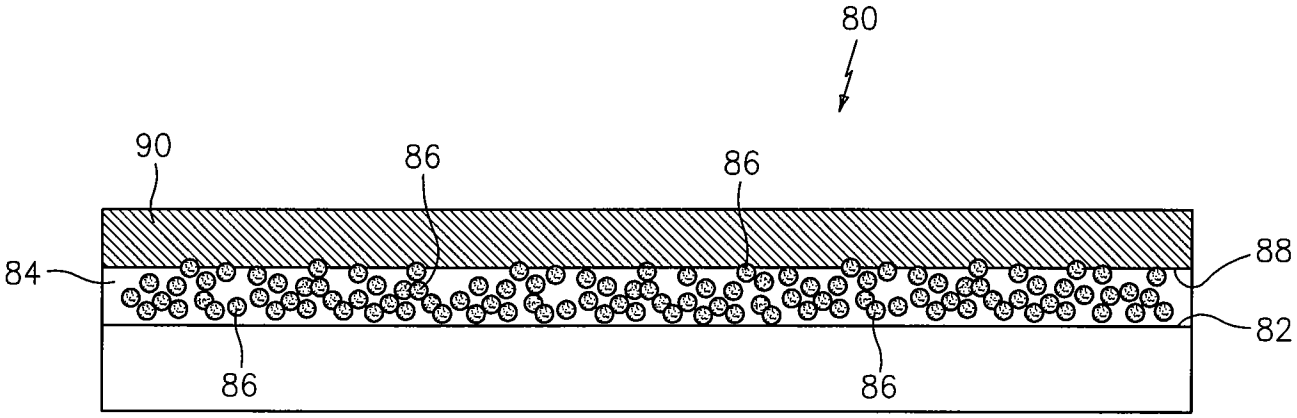
FIG. 5 is a representation of still yet another exemplary coated article made in accordance with the exemplary process #2 of FIG. 1.

Referring specifically to FIG. 5, another resultant coated article 80 of process #2 may comprise at least one surface 82 having disposed thereupon a non-conductive material layer 84 having a plurality of electrically conductive material 86 dispersed throughout the layer 84 to form the aforementioned percolation network described above with reference to article 40. The article 80 further includes a conductive material layer 90 disposed upon a surface 88 of the non-conductive material layer 82. The resultant total thickness of combined layers 84, 90 may be about 100 nanometers to about 10,000 nanometers.

One or more embodiments of the present invention have been described. Nevertheless, it will be understood that various modifications may be made without departing from the spirit and scope of the invention. Accordingly, other embodiments are within the scope of the following claims.

What is claimed is:

1. A process for providing a conversion coating on an aluminum alloy article, comprising:

contacting an article with a first solution to produce a coated article, said first solution includes a solvent and at least one non-conductive material comprising at least one oxide of a metal, and said coated article having at least one surface with a layer of said non-conductive material;

contacting said coated article with a second solution which includes a solvent and at least one conductive material comprising at least one of: graphite, metals, conductive ceramics, semi-conductive ceramics, intermetallic compounds, and mixtures thereof, thereby producing a further coated article having said layer on said at least one surface and having said at least one conductive material in contact with said layer and said at least one surface; and drying said further coated article to produce a dried coated article having a conversion coating on said at least one surface, said conversion coating having said layer on said at least one surface and said at least one conductive material in contact with said layer and said at least one surface, wherein the drying takes place at a temperature of between 25° C. and 125° C., wherein during the step of contacting said coated article with a second solution, the conductive material from the second solution infiltrates pores of the layer of said non-conductive material to reach the at least one surface.

2. The process of claim 1, further comprising the steps of:

contacting the dried coated article with a third solution to form an electrically conductive material layer upon said non-conductive material layer having said conductive material, said third solution includes a solvent and at least one electrically conductive material; and drying the coated article contacted by the third solution.

3. The process of claim 1, further comprising the steps of:

pretreating an article to be coated prior to contacting said article with said first solution;

rinsing said coated article prior to drying said coated article; and rinsing said further coated article after contacting with said second solution.

4. The process of claim 2, wherein at least one of the contacting steps comprises at least one of the following processes: immersion, air spray, electrostatic deposition, brush application, flood coating, chemical conversion, inward diffusion, outward diffusion, low pressure plasma-spray, air plasma-spray, sputtering, cathodic arc, electron beam physical vapor deposition, high velocity plasma spray techniques, combustion processes, wire spray techniques, laser beam cladding, electron beam cladding, sol gel, cold spray, sputtering and chemical vapor deposition.

5. The process of claim 2, wherein said first solution, said second solution and said third solution are maintained at a pH range of about 3.5 to about 10.5.

6. The process of claim 1, wherein at least one of the contacting steps comprises any one of the following processes: immersion, spraying or brushing.

7. The process of claim 1, wherein contacting comprises contacting said article with said first solution for a period of time of about 1 minute to about 10 minutes, and contacting said article with said second solution for a period of time of about 1 minute to about 10 minutes.

8. The process of claim 1, wherein said at least one oxide of a metal includes at least one of the following: aluminum oxide, titanium oxide, zirconium oxide, hafnium oxide and silicon oxide.

9. The process of claim 1, wherein said first solution further comprises at least one of the following organic corrosion inhibiting species: benzothiazolyl thio succinic acid, benzotriazole, toluoyl propionic acid, dimercaptothiodiazole, 2-mercaptobenzimidazole, and mixtures thereof.

10. The process of claim 1, wherein the at least one conductive material forms a percolation network extending from said at least one surface to a surface of said layer of said non-conductive material.

* * * * *